United States Patent [19]

Strauss

[11] 3,953,552

[45] Apr. 27, 1976

[54] AGITATION FLOTATION CELL FOR THE PREPARATION OF MINERALS AND COALS

[75] Inventor: Werner Strauss, Bochum, Germany

[73] Assignee: Klockner-Humboldt-Deutz Aktiengesellschaft, Germany

[22] Filed: Jan. 28, 1975

[21] Appl. No.: 544,698

[30] Foreign Application Priority Data

Jan. 29, 1974 Germany ..... 2404032

[52] U.S. Cl. ..... 261/93; 209/169; 416/183; 416/184

[51] Int. Cl.[2] ..... B03D 1/18

[58] Field of Search ..... 209/169; 210/44, 22; 261/87, 93; 416/184, 185, 188, 183; 259/7, 8, 23, 24, 43, 44, 107, 108

[56] References Cited

UNITED STATES PATENTS

| | | | |
|---|---|---|---|
| 2,243,309 | 5/1941 | Daman et al. | 209/169 X |
| 2,871,000 | 1/1959 | Dowling | 259/8 X |
| 3,420,370 | 1/1969 | Isenhardt et al. | 209/169 |
| 3,679,323 | 7/1972 | Buck | 416/184 X |
| 3,843,101 | 10/1974 | Green | 259/107 X |

*Primary Examiner*—Frank W. Lutter
*Assistant Examiner*—Ralph J. Hill
*Attorney, Agent, or Firm*—Hill, Gross, Simpson, Van Santen, Steadman, Chiara & Simpson

[57] ABSTRACT

An agitation flotation cell for the preparation of minerals and coals having a vertical rotatable shaft surrounded by an air intake pipe with upper and lower annular plates coaxial with the shaft each having central agitation intake openings and an agitator carried on the shaft between the plates including a plurality of outwardly extending agitator paddles having axially facing surfaces with the paddle surfaces positioned at different oppositely disposed angles relative to an orbit plane at right angles to the axis of the shaft producing opposed axial thrust forces on the material agitated in the shaft with radially extending vanes between the paddles with the vanes being substantially parallel to the shaft.

6 Claims, 7 Drawing Figures

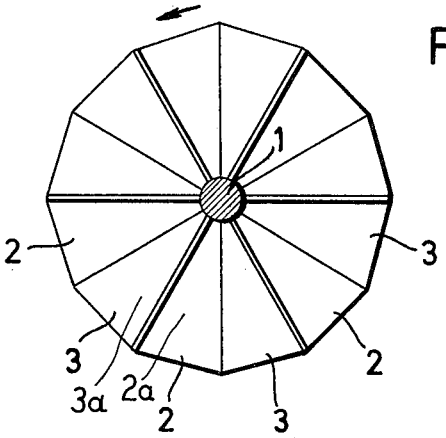
FIG. 1
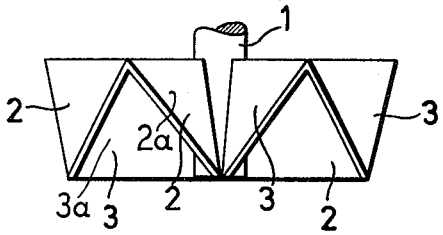
FIG. 2
FIG. 3
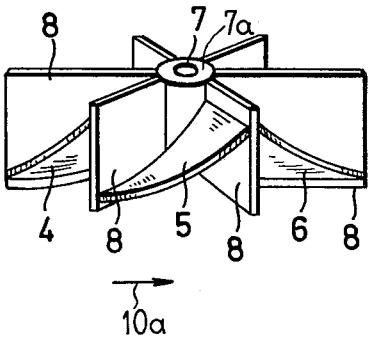
FIG. 3a
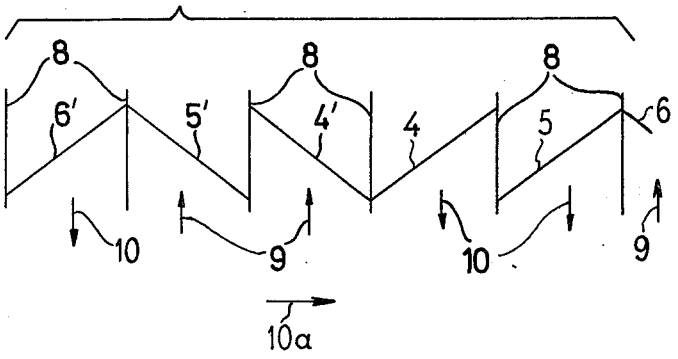

AGITATION FLOTATION CELL FOR THE PREPARATION OF MINERALS AND COALS

BACKGROUND OF THE INVENTION

The invention relates to improvements in agitation flotation cell structures for the preparation of minerals and coals wherein an agitating assembly is positioned at the lower end of a rotatable agitating shaft and a froth producing agitation is given to a liquid suspension in a container for the induction of air in the formation of froth in the flotation process.

Such an agitation mechanism is shown and described in German Patent No. 1,186,422, and in U.S. Pat. No. 3,420,370, Isenhardt et al., the disclosures of which are fully incorporated herein by reference. In this type of structure, a rotatable vertical agitating shaft is positioned within a flotation chamber and has an agitator at its lower end including outwardly extending agitating members. A central air feed pipe introduces air into the flotation chamber for induction into the liquid suspension of minerals within the chamber. Such a structure must provide effective turbulence of the mixture for carrying out the flotation process.

Various efforts have been made in the art to provide improved flotation agitator structures, and one structure is shown in the above patents wherein a disc is provided which is at an angle to the agitation shaft with members at the edge of the shaft, and such a construction leads to large structural heights of the agitator and increases the bulk and cost for large flotation units and frequently is uneconomical because of space requirements.

It is accordingly an object of the present invention to provide an improved agitator construction for froth flotation units which permits a substantial lowering of the structural height and diameter of the unit, and yet which provides an improvement in the agitation effects and enables the improved inducement of air and mixture with the sludge in a simple and economical manner. In accordance with the principles of the invention, the agitator is provided with disc sectors or paddles which are mounted on the agitator shaft at oppositely disposed inclinations. That is, assuming an orbit plane at right angles to the shaft, the sequential outwardly extending paddles are arranged at angles to the orbit plane and are preferably at sequentially reverse angles so that the axial thrust on the suspension of material being agitated, and on the shaft are in opposed axial directions relative to the individual disc sectors. The turbulence of air and sludge in the agitation chamber is substantially improved over units heretofore available. The intensive turbulence attained with the agitator in accordance with the invention results in an increase in degree of efficiency and an increase of output and an improved product. Also, the invention provides a particularly sturdy and strong unit of compact construction which is capable of operating efficiently with large flotation units as well as with presently existing smaller flotation units and can be readily installed and operated in existing units without substantial modification of the structure.

A further object of the invention is to provide a more compact agitator unit which does not require the height of units heretofore used.

A still further object of the invention is to provide an agitator unit wherein a particularly effective distribution of air into fine bubbles and intimate admixture of the bubbles with the flotation sludge is attained in the flotation cell.

A still further object of the invention is to provide an improved agitator for a flotation unit wherein axial forces are controlled and reduced on the shaft and are such that they are axially reversed with a full rotation of the shaft so that reversal and thrusts are experienced by the flotation admixture for improved formation of froth.

A feature of the invention is the provision of paddles which are arranged at reverse angles for improved effects on the material and improved resultant thrusts. Vanes are positioned between the paddles and extend radially and parallel to the shaft and stabilize the agitator and coact with the paddles for a reinforced turbulence of air and sludge in the flotation chamber.

Other objects, advantages and features, as well as equivalent structures which are intended to be covered herein, will become more apparent with the teaching of the principles of the invention in connection with the disclosure of the preferred embodiments in the specification, claims, and drawings in which:

DRAWINGS

FIG. 1 is a plan view of the agitator structure constructed in accordance with the principles of the present invention;

FIG. 2 is an elevational view of the agitator of FIG. 1;

FIG. 3 is a perspective view showing another form of agitator with the view being in perspective;

Figure 4:
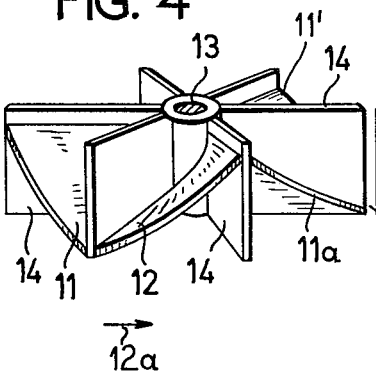
Figure 4A:
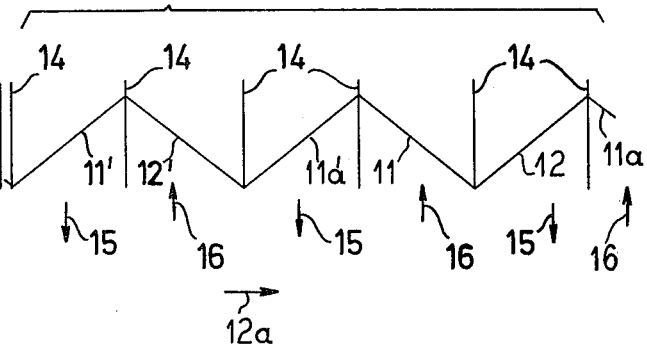
Figure 5:
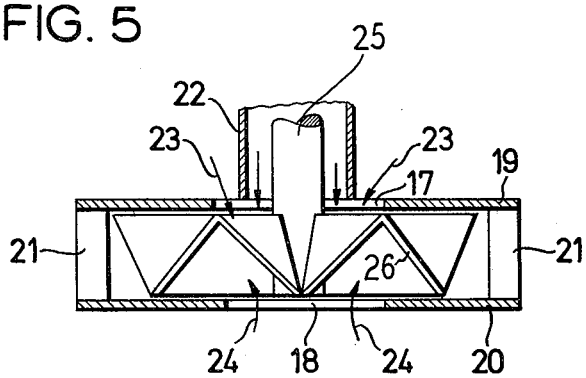

FIG. 3*a* is a diagrammatic illustration of the relative position of the paddles and vanes looking radially inwardly;

FIG. 4 is a perspective view illustrating still another form of the invention;

FIG. 4*a* is a schematic view showing a relationship between the paddles and vanes; and FIG. 5 is a vertical sectional view illustrating the agitator assembly with mechanism for controlling flow of the liquid sludge and air.

DESCRIPTION

As illustrated in FIGS. 1 and 2, pairs of agitator paddles of similar construction are shown attached and supported to a central vertical agitator shaft 1. The arrangement is illustrated with six pairs of paddles arranged circumferentially around the shaft and extending outwardly therefrom. As illustrated particularly in FIG. 2, the paddles 2 and 3, which may also be termed disc sectors, are contiguous and are each at an angle to an orbit plane which may be defined as a plane extending at right angles to the axis of the shaft 1. That is, one of the paddles of the pair, namely, paddle 2 is arranged at an angle so that with rotation of the shaft 1 in the direction indicated by the arrowed line in FIG. 1, the leading surface 2*a* of the paddle 2 faces in an upward direction, and the leading surface 3*a* of the paddle 3 faces in a downward direction. With this arrangement, reverse thrusts of substantial equal and opposite direction are experienced by the shaft 1, and reverse thrusts are applied to the material in flotation in the chamber in which the agitator is carried in accordance with the type of chamber shown in the aforementioned patents. Also, with the pairs of paddles arranged at uniform angles relative to the orbit plane, and being of uniform size, the vertical up and vertical down thrusts will cancel each other in an axial direction. Also, circumferential reactance forces on the shafts will all be directed inwardly through the center axis of the shaft and will cancel each other so that no lateral thrust is experienced on the shaft so as to create a bending moment. Also, turbulence in mixing and induction of air into the froth will occur uniformly throughout 360°. This will result in an intensive turbulence of air with the sludge introduced into the flotation cell. The agitator, because of its compact size and sturdy construction, may be used in conventional and presently used flotation cells as well as in new large space flotation cells.

The paddles are joined to each other along their leading and trailing edges, and for example, the upper edges of the paddles 2 and 3 may be of one-piece or joined, as by welding, and the leading edge of the paddle 2 may be attached to the trailing edge of the paddle 3 of the preceding pairs of paddles. Also, the trailing edge of the paddle 3 is attached to the leading edge of the paddle 2 of the succeeding pair. The inner radial edges of the paddles are suitably secured, such as by welding to the center shaft 1.

In the construction illustrated in FIG. 3, paddles are shown at 4, 5 and 6. These paddles are mounted to a center shaft 7 which is shown with a central hub 7*a* at its lower end. The paddles 4, 5 and 6 are shown on the front side of the agitator in FIG. 3, and similar paddles will be arranged on the backside with a repetition of the pattern illustrated by the paddles 4, 5 and 6. Between the paddles are radially extending vertical vanes which are essentially parallel to the shaft 7 and which are uniformly spaced with the paddles being of essentially uniform length circumferentially. The paddles 4 and 5 are arranged to have a similar angle of inclination relative to the axis of the shaft, that is, to the orbit plane which extends at right angles to the shaft axis. This orbit plane may also be termed the rotational plane of the shaft, and is the plane intersecting the axis of the shaft at right angles thereto. The agitator paddle 6 is positioned having an oppositely disposed inclination. The relative positions of the vanes 8, and the paddles therebetween is shown is shown in the schematic layout to the right of FIG. 3.

The leading and trailing edges of the paddles 4, 5 and 6 are secured to the vertical surfaces of the vanes 8. Also, the inner edges of the paddles may be secured to the hub 7*a* at the center. The paddles are preferably planar, but may be slightly curved for agitation effect and for aid in attachment to the surfaces of the vanes.

The paddles are preferably attached slightly downwardly from the upper edge of the vanes and slightly upwardly from the lower edges of the vanes. Thus, the overall height of the agitator assembly is controlled by the height of the vanes 8.

The schematic diagram to the right of FIG. 3, designated FIG. 4*a* illustrates the vertical thrust forces by the arrowed lines 9 and 10. As illustrated, the paddles 4 and 5, when the rotor is rotated in the direction indicated by the arrowed line 10*a*, create a vertical upward pushing force or thrust on the material being agitated. This, of course, creates a vertical downward force on the shaft, and the arrowed lines 9 and 10 represent the forces applied to the material in the chamber.

FIG. 3 is a schematic view taken looking circumferentially inwardly with the paddles 6', 5', and 4' being on the backside of the agitator of FIG. 3. The paddles 6' and 4 and 5 create a downward thrust on the material as indicated by the arrowed lines 10, and the paddles 5', 4' and 6 create an upward thrust as indicated by the arrowed lines 9. The vanes 8 contribute substantially to intensifying the turbulence of air and sludge in the flotation cell. They also provide an increase in stability of the agitator. The direction of rotation is shown schematically in FIGS. 3 and 3*a* by the arrowed line 10*a*.

FIG. 4 shows another form of the agitator wherein each successive paddle is alternated in direction of angle circumferentially around the agitator assembly. The paddles on the front side of the agitator are shown at 11, 12 and 11*a*, and on the rear side of the agitator are shown schematically in FIG. 4*a* at 11', 12' and 11*a'*. The paddles 11', 11*a'* and 12 provide a vertical downward thrust on the material in the chamber as indicated by the arrowed lines 15. The paddles 12', 11, and 11*a* create a vertical upward thrust on the material as indicated by the arrowed lines 16, assuming a direction of rotation indicated by the arrowed line 12*a*. FIG. 4 is a schematic view of the position of the paddles and vanes.

In this arrangement, as contrasted with FIG. 3, the reversal of the thrust or pushing forces is more frequent, and changed with each of the paddles. The paddles are preferably at the same angle although reversed, with respect to an orbit plane which is at right angles to the shaft 13. As in previous constructions, the paddles are secured at their leading and trailing edges to vertical radially extending vanes 14. The base of the paddles are attached preferably to the lower edge of the vanes, and attached at their upper edges slightly downwardly from the upper edges of the vanes, and the total height of the agitator is defined by the height of the vanes 14.

With this arrangement of FIG. 4, each of the paddles and vanes may have the same dimensions.

FIG. 5 shows an arrangement with a central shaft 25 which is of similar construction to the shaft 1 in FIGS. 1 and 2. Also, the paddles 26 are of similar construction to that shown in FIGS. 1 and 2 and need not be described in additional detail. FIG. 5 also illustrates an upper annular plate 19 with a central opening 17 being coaxial with the shaft 25. Also extending coaxial with the shaft is an air inlet pipe 22 which has a lower opening coaxial with the opening 23 in the plate.

A lower plate 20 is spaced axially downwardly from the upper plate, and has a central coaxial inlet opening 18. Vertical ribs 21 extend between the plates and maintain them in their spaced relationship, with the paddles 26 of the agitator being positioned in the space between the plates. With this arrangement, air flows downwardly through the pipe 22 and is induced into the suspension of sludge which flows inwardly as indicated by the arrowed lines 23. Additional sludge flows upwardly through the opening 18 as indicated by the arrowed lines 24, and with the severe agitation and turbulence which is provided, frothing and foaming is created. The air-sludge mixture created by the rotation of the shaft 25 is thrown outwardly and impacts against the ribs 21 thereby creating additional turbulence and breaking up the air bubbles further into finer and smaller bubbles.

The construction of the invention achieves the objects and advantages hereinabove set forth and provides an agitator assembly which has improved output and efficiency over structures heretofore available. Further its adaptability to varying sizes of flotation structures is significant, and it is capable of operating with very large units.

I claim as my invention:

1. An agitator for use in an agitator flotation unit for the preparation of minerals and coals having an agitation shaft with an air supply pipe opening at the lower end of the shaft, comprising:

a vertical shaft;

an air induction agitator unit at the lower end of the shaft having a plurality of axially extending vanes projecting radially outwardly from the shaft and being circumferentially spaced apart a distance less than 180°;

agitator paddles with a paddle between each of the vanes being at an angle to the vanes at an inclined angle relative to the plane of rotation of the shaft with the axial height of the paddles being no greater than the axial height of the vanes.

2. An agitator for use in an agitator flotation unit for the preparation of minerals and coals having an agitation shaft with an air supply pipe opening at the lower end of the shaft, constructed in accordance with claim 1:

wherein certain paddles circumferentially adjacent each other extend at the same angle to the rotational plane and other successive paddles extend at opposite angles.

3. An agitator for use in an agitator flotation unit for the preparation of minerals and coals having an agitation shaft with an air supply pipe opening at the lower end of the shaft, constructed in accordance with claim 1 wherein said paddles are secured to the vanes at a location spaced axially inwardly from the upper and lower edges of said vanes.

4. An agitator for use in a flotation unit for the preparation of minerals and coals having an agitation shaft with an air supply pipe opening at the lower end of the shaft, constructed in accordance with claim 1:

wherein paddles adjacent each other on opposite sides of a common vane have an opposite angle of inclination relative to the plane of rotation of the shaft.

5. An agitator for use in a flotation unit for the preparation of minerals and coals having an agitation shaft with an air supply pipe opening at the lower end of the shaft, constructed in accordance with claim 1:

wherein the paddles extend radially inwardly to join the shaft

6. An agitator for use in a flotation unit for the preparation of minerals and coals having an agitation shaft with an air supply pipe opening at the lower end of the shaft, constructed in accordance with claim 1:

wherein the vanes extend radially inwardly and are attached to the shaft at their inner edges.

* * * * *